United States Patent [19]

Penven

[11] Patent Number: 4,846,231

[45] Date of Patent: Jul. 11, 1989

[54] SEAM DESIGN FOR SEAMED FELTS

[75] Inventor: Patrick H. Penven, Clinton, S.C.

[73] Assignee: Asten Group, Inc., Charleston, S.C.

[21] Appl. No.: 190,030

[22] Filed: May 4, 1988

[51] Int. Cl.[4] ..... D03D 3/04

[52] U.S. Cl. ..... 139/383 A; 162/DIG. 1

[58] Field of Search ..... 139/383 A, 383 AA; 162/348, 358, DIG. 1; 24/33 P

[56] References Cited

U.S. PATENT DOCUMENTS

| | | | |
|---|---|---|---|
| 2,883,734 | 4/1959 | Draper, Jr. . | |
| 2,907,093 | 10/1959 | Draper, Jr. . | |
| 3,283,388 | 11/1966 | Kelleher et al. . | |
| 3,309,790 | 3/1967 | MacBean . | |
| 3,815,645 | 6/1974 | Codorniu . | |
| 4,026,331 | 5/1977 | Lees et al. . | |
| 4,123,022 | 10/1978 | Dutt et al. . | |
| 4,141,388 | 2/1979 | Romanski et al. . | |
| 4,186,780 | 2/1980 | Josef et al. . | |
| 4,364,421 | 12/1982 | Martin . | |
| 4,401,137 | 8/1983 | Cannon . | |
| 4,438,788 | 3/1984 | Harwood | 139/383 AA |
| 4,500,590 | 2/1985 | Smith . | |
| 4,658,863 | 4/1987 | Errecart | 139/383 AA |
| 4,683,624 | 8/1987 | Dufour . | |

FOREIGN PATENT DOCUMENTS

| | | | |
|---|---|---|---|
| 982682 | 2/1965 | United Kingdom . | |
| 2178766 | 2/1987 | United Kingdom | 139/383 AA |

*Primary Examiner*—Henry S. Jaudon

*Attorney, Agent, or Firm*—Volpe and Koenig

[57] ABSTRACT

An improved loop construction for use in closing the ends of an open papermaker's fabric is disclosed. The loop construction, as disclosed, is elongated to achieve a minimum loop length. The loop is formed by an arcuate portion which defines the free end of the loop and adjacent crossing portions which are interwoven with the fabric body in a repeated pattern. As a result of the disclosed construction, the continuous arcuate portion of the seaming loop is positioned vertically with respect to a plane through the horizontal plane of the fabric and the crossing portions are within 15° of the perpendicular to the horizontal plane of the fabric.

10 Claims, 4 Drawing Sheets

SEAM DESIGN FOR SEAMED FELTS

FIELD OF THE INVENTION

This invention relates generally to a joint construction for a papermakers fabric. More particularly, the invention relates to pintle seamed joints for papermakers wet press felts.

BACKGROUND OF THE INVENTION

In conventional papermaking machines, wet felts convey the sheet of paper, paperboard, etc., from the wire or cylindrical mold through various water removing equipment.

Such wet felts are often woven endless and are applied as such to the rolls of the papermaking machine. The installation of endless wet felts in the past has required cessation of operations for extended periods of time with the resultant loss of production from the paper machine.

Recent developments have resulted in greater use of seamed press felts which are joined or seamed by a pintle to simulate the endless condition. This construction is generally described as a pintle seamed joint. The inability to produce a pintle seamed joint geometry which does not differ substantially from the plane of the fabric body has been a major fault with this newer construction.

In view of the prior failures, the present invention teaches the use of stuffer yarns in an extended fabric weave loop adjacent the seam area. Although this is occasionally contray to the theory of continuing the same weave through the seam fabric area, the invention permits greater control over the seam configuration and in fact results in a more uniform fabric geometry at the seam.

U.S. Pat. No. 2,883,734 provided a wet felt of a woven open-ended strip construction which was made endless by joining together the extensions of yarn from the weave of the felt at the joining ends thereof. One end of the wet felt is fed through the dryer section of the machine, until it completes a full loop. The yarn extensions at the joining ends of the felt are continuous with the weave system thereof and are used for joining together the two ends of the felt, and a textile yarn or cord is used to secure both sets of yarn extensions together and retain the two ends of the felt connected together to form an endless belt structure. Thus, the wet felt is installed without having to disassemble the machine.

The art is replete with descriptions of seam constructions for papermakers felts; see for example the disclosures of U.S. Pat. Nos. 2,883,734; 3,283,388; 3,309,790; 4,123,022; 4,141,388; 4,186,780 and 4,364,421. In general, the seam constructions of the prior art have not been entirely satisfactory for all purposes and applications. The problem with the seam constructions of the prior art, is its geometry. That is, because the surface of the felt is not smooth there is an increased likelihood of sheet marking.

U.S. Pat. No. 4,500,590 issued Feb. 19, 1985 to Smith, attempts to solve this problem via a composite pintle including a polyester core and an outer low-melt polymeric sheath which has been softened and deformed. This composite pintle exhibits a profile which occupies void areas in the mesh of the helical fabric in the area of the pintle joint.

DESCRIPTION OF THE PREFERRED EMBODIMENT

Certain terminology will be used in the following description for the purpose of simplified disclosure and is not intended to be limiting.

Figure 1:
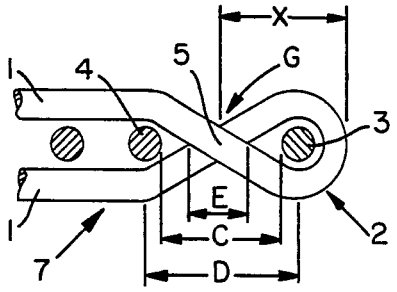
FIG. 1 PRIOR ART
FIG. 1 illustrates a loop construction in accordance with the prior art.

FIG. 1 is a portion of a prior art seam construction in a woven fabric which includes a plurality of machine direction yarns 1 interwoven with a plurality of cross machine direction yarns 4. In order to seam the fabric, a plurality of integral contiguous seaming loops 2 are formed at each terminal end of the woven fabric. The seaming loops 2 are formed using techniques known in the art. To place the fabric in service, loops from each end of the fabric are intermeshed to form a channel and a pintle, such as 3, is inserted to retain the fabric ends together in a substantially continuous, endless structure.

In the prior art construction, the machine direction yarn 1 is looped, reversed and passed in a mirror image weave with the end cross machine direction yarn 4. This may be done during weaving, which is preferable, or in a subsequent operation. The machine direction yarn 1 then forms a crossover 5 and a loop 2. The center to center distance between the last cross machine direction yarn 4 and the pintle channel or eye of loop 2 is designed D. The distance X indicates the overall free length of the loop 2 from the center of the crossover 5. The distance C is the length of the crossover portion between yarn 4 and the pintle 3 in the eye of loop 2. The distance E is the length of the contact between the forward and rearward sections of the yarn forming the crossover 5.

The prior art seam construction is deficient in that the distance D is such that the length C of the crossover portion is substantially elongated beyond the length E and a surface void or gap G is created in the respective paper carrying and machine side surface planes of the felt. The void or gap G tends to leave markings on the sheet, even after a batt is secured to the fabric. The prior art attempts to reduce the size of G, have not been altogether successful.

Figure 2:
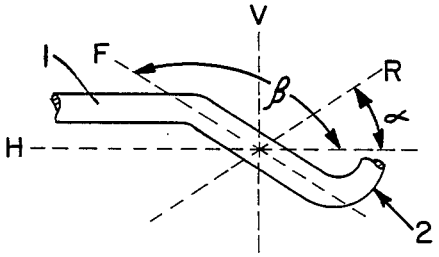
FIG. 2 PRIOR ART
FIG. 2 illustrates a portion of the loop construction according to the prior art.

FIG. 2 is a partial view of the forward section of the machine direction yarn 1 from FIG. 1. The solid plane F indicates a plane along the longitudinal axis of the forward section of the yarn forming crossover 5. The broken plane R indicates a plane along the longitudinal axis of the rearward section of the yarn forming crossover 5 and is a mirror image of the forward section. The plane H indicates the horizontal plane of the woven fabric through the center of the eye of loop 2. The plane v indicates the vertical plane perpendicular to plane H. The obtuse angle $\beta$ is directly related to the distances C and D. The greater these lengths differ, the more the angle $\beta$ will exceed 90°. The acute angle $\alpha$ is likewise related to the distance C and D. As those lengths increase $\alpha$ is further decreased from 90°.

It has been found that in order to eliminate or substantially reduce the gap G, the angles $\alpha$ and $\beta$ should approach each other and 90° as closely as possible and the difference between planes F and R should approach zero. Stated in another way, the difference between the distances c and E approaches zero.

Figure 3:
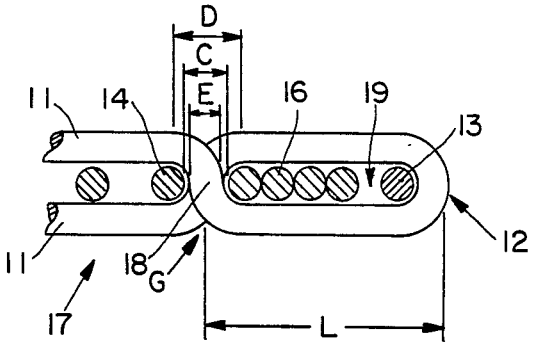
FIG. 3 illustrates an elongated loop construction in accordance with the invention.

In the preferred embodiment of the invention, FIG. 3, a machine direction yarn 11 extends over the end cross machine direction yarn 14, is formed into a loop of the length L and weaves back into the fabric in a mirror image. This produces crossover 18 and the loop 12. The loop length L, as shown, is at least three times the average diameter of the cross machine direction yarns plus the projected pintle diameter and the machine direction yarn diameter. As illustrated L is four times the average diameter plus the pintle and the machine direction yarn diameter. Accordingly, an elongated aperture 19 is created between the free end of the loop 12 and the contiguous fixed end thereof at crossover 18. Aperture 19 always has a length of at least three times the average diameter of the cross machine direction yarn. A number of stuffers 16 are inserted in the aperture or channel 19 between the pintle 13 and the crossover 12. The remaining space in between the stuffers and the pintle accommodates the corresponding loop from the opposite end of the fabric. The addition of the stuffers 16 alters the loop geometry, at the crossover 18, to almost 90° and physically maintains that position.

Generally, the more stuffers that can be inserted, the easier it becomes to form the optimum 90° angle. That is, the angles $\alpha$ and $\beta$ come closer together and will more nearly approximate 90°. Likewise, the distances C and E approach each other and the difference is ideally zero. Note that in the invention the distance E is measured to the first stuffer 16 which occupies the position of the pintle in the prior art construction. This is contrary to the prior art seam loop construction, where increasing the length of the loop increased the difference between the angle. It will be understood that as the length L increases, the amount of stuffers increases to create the required geometry. As can be seen by comparing FIGS. 1 and 3, the size of the geometrical void G is considerably smaller in the invention (FIG. 3) than the prior art (FIG. 1).

Figure 4:
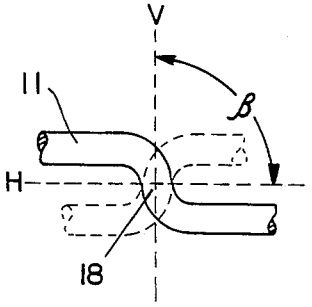
FIG. 4 illustrates a loop construction in accordance with the present invention.

FIG. 4 is a partial view of the machine direction yarn 11 in FIG. 3 and is comparable to FIG. 2. The angle $\beta$ indicates the angle from the plane H to the vertical plane V of the machine direction yarn at the crossover 18. To get the best results the angle $\beta$ should approximate 90°. With an approximately 90° angle, the dimension of the geometrical void in the surface of the seam construction will be minimized. This is indicated by the rearward portion of crossover 18 which is shown in phantom. Note that the crossover portions are nearly vertical and aligned with each other.

Figure 5:
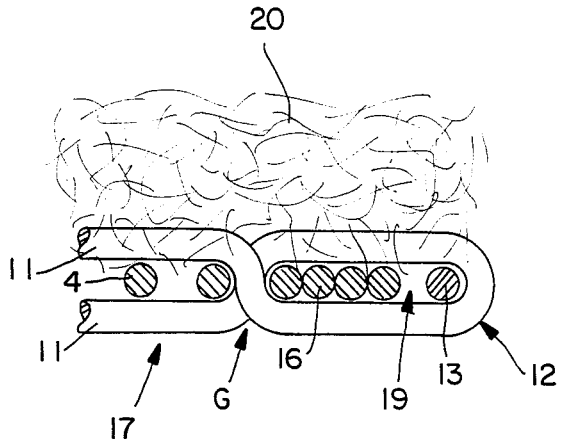
FIG. 5 shows the seam construction of FIG. 3 with a batt thereon.

FIG. 5 shows the seam construction of FIG. 3 with a batt 20 thereon. The batt can be needled into the stuffers 16 in the same manner as with the cross machine direction yarns 4. This enables the batt to be strongly anchored to the seam. In addition, the stuffers provide control over differences in the permeability and density between the seam area and the woven fabric.

Figure 6:
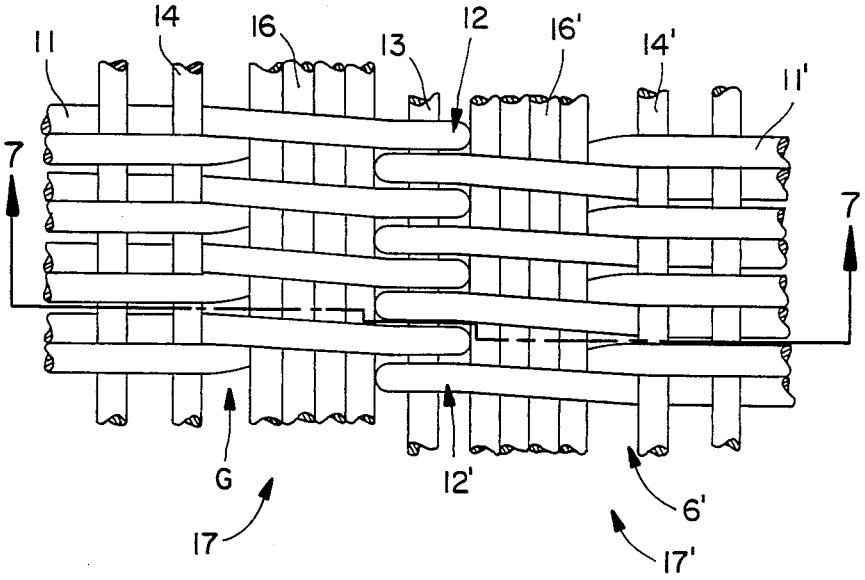
FIG. 6 is a top plan view of a completed seam according to the invention.
Figure 7:
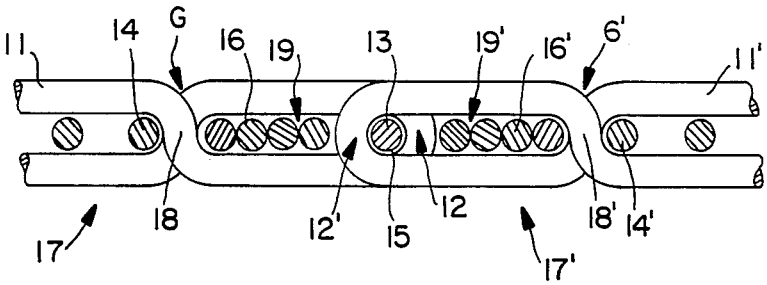
FIG. 7 is a section of the seam of FIG. 6 taken through the line 7—7 and illustrates alternative stuffers.

In FIGS. 6 and 7, the prime numbers indicate the identical counterparts of the opposing end of the woven fabric.

FIG. 6 shows a partial surface view of the opposing terminal ends 17 and 17' of the endless fabric belt, without a batt, being interconnected via the pintle 13.

FIG. 7 is a cross section of FIG. 6 which more clearly shows the minimum geometrical voids G and G' and the final seam construction.

To place the woven fabric of the invention in service, it is fitted around the usual cylinders with the terminal ends 17 a nd 17' juxtapositioned. The end loops 12 are then intermeshed to form the pintle channel 15. The free end of respective loop abuts the stuffers of the opposite end. A pintle 13 is passed through the pintle channel 15 to interconnect the fabric ends. Although an optimum 90° angle at the crossovers 18 and 18' minimizes the voids G and G', it is very difficult to obtain such complete control of the yarns. In practice, crossover portions, 18 and 18' which form a substantially vertical plane perpendicular to the horizontal plane of the fabric at about 90°±15° will provide the benefits of the invention.

Figure 8:
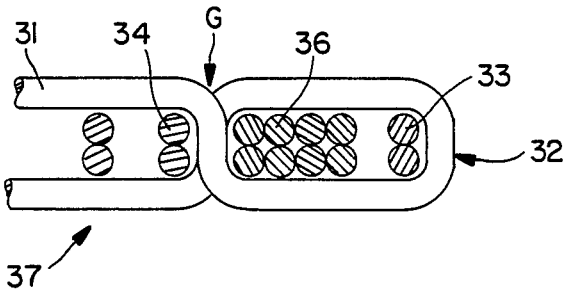
FIG. 8 is a side view of a seam construction in accordance with an alternative embodiment of the invention.

FIG. 8 is a side view of a seam construction in accordance with an alternate embodiment of the invention. This embodiment shows that the invention is equally applicable to multi-layered fabrics. In multi-layered fabrics, plural layers of cross machine direction yarns 34 are used to interweave with machine direction yarns 31. When plural layers of cross machine direction yarns are used, a corresponding increase in stuffer material 36 is used. This creates the same loop geometry 32 that is obtained in the preferred embodiment. Multiple pintles 33 may be used.

Figure 9:
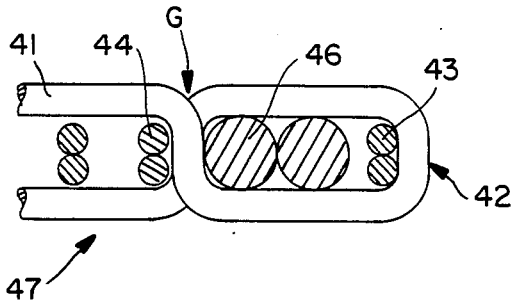
FIG. 9 is a side view of another alternative embodiment of a seam construction in accordance with the invention.

FIG. 9 is a side view of another seam construction in accordance with an alternate embodiment of the invention. This embodiment also pertains to the use of multi-layered fabrics. As described above, multi-layered fabrics use plural layers of cross machine direction yarns 44 interwoven with machined direction yarns 41. Accordingly, for every increase in cross machine direction yarns a corresponding increase of stuffer material is used. However, this construction illustrates the use of a single layer of stuffer material 46 that equal the required stuffer area. Multiple pintles 43 may still be used.

With respect to actual construction of the fabric and the seaming loops, it is recognized that the fabric may be flat woven and the seaming loops formed through known loop forming techniques or back weaving. Likewise, the fabric may be woven endless or circular and that the loops be formed in the loom as part of the weaving process. These weaving techniques will be known to those skilled in the art. In the known techniques, a looping wire or similar device is used to form the actul loop and to simulate the pintle location during weaving. The stuffers will be placed within the loop aperture during weaving in the usual manner of applying stuffers to the woven fabric. During weaving, the stuffers are merely laid in the weave as it progresses on the loom without interweaving. Similarly, the stuffers may be inserted in a previously woven fabric during loop formation or back weaving.

It will be understood by those skilled in the art that the machine direction yarns of the fabric are woven as the cross machine direction yarns in an endless loom. Accordingly, the terms machine direction and cross machine direction will apply to the fabric on the papermaking machine and do not refer to its loom position.

With reference again to FIG. 5, it will be appreciated that the batt 20 can be applied to the woven fabric through needling or the application of adhesives. When needling is utilized it will generally stabilize the location of the stuffers through intermingling of fibers. When adhesives are utilized but do not penetrate to the level of the stuffers, it is preferred to fix the stuffer by other means. Thus, the stuffers may be retained relative to each other and the fabric by an adhesive. Likewise, the stuffers may be retained by application of a suitable material at the selvages of the fabric. Generally, papermakers fabric are subjected to heat setting and further processing which assist in stabilizing the fabric. The actual stabilizing method is subject to design considerations and will be known to those skilled in the art.

With respect to the yarns employed in the present invention, it is preferred to utilize continuous monofilament yarns. However, it is recognized that multi-filament yarns and cotton count yarns may be utilized. With respect to the stuffer yarns, it will be recognized that the stuffers may be of the same material as the remainder of the fabric or may be selected for certain characteristics. Those skilled in the art will recognize that stuffer yarns are often spun yarns or cotton count yarns which are selected to achieve certain characteristics of permeability and density in the seam area.

Figure 10:
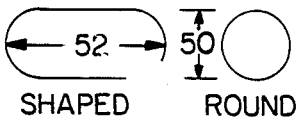
FIG. 10 illustrates various yarn shapes which may be utilized in fabrics according to the invention.

With respect to the yarn geometry, the present description has referred to circular yarns which may be generally described by their diameter or axis, see FIG. 3. However, shaped yarns, as shown in FIG. 10, compare with circular yarns and may be utilized in the present invention. By way of further explaining the invention, assume that the cross machine direction yarns are generally flat and rectangular as depicted in FIG. 10. In this case, the horizontal axis yarn 52 will be treated as the longitudinal or horizontal component of the yarn for determining the length of the loop and the required aperture. The vertical axis 50 will correspond generally to yarn diameter in a circular yarn and will determine the height of the stuffer.

A one to one correlation between the stuffers and the cross machine direction yarns is not required. Accordingly, one or more circular stuffers having a diameter which conforms to the vertical axis of the shaped monofilamet may be combined to produce the total horizontal length required in the aperture.

In accordance with the above, it will be recognized that multilayer constructions will not require a one to one correlation between the stuffers and the cross machine direction yarns. Once again, it is the relationship between the total stuffer geometry and the cross machine direction geometries which must be harmonized.

In general, the desired elongated loop may be initially formed by placing the machine direction yarns under tension. However, the application of tension to the fabric in the machine direction will often result in crimp interchange and shifting of the cross machine direction yarns. Accordingly, the stuffers may be utilized to preserve the weave structure and to prevent loop crushing. In addition, utilization of stuffers enables a loop structure having a gauge or caliper which is substantially identical to that of the fabric. Utilization of a smaller diameter pintle wire will reduce loop caliper. Although the elongated loop will not have the same rotational tendencies of the prior art loop, the stuffers help to maintain fabric caliper throughout the length of the elongated loop. By selecting stuffers which have an average diameter which is less than that of the cross machine direction yarns, it is possible to compensate for the crimp in the fabric weave and to obtain substantially the same caliper throughout the fabric and seam area. Furthermore, stuffers reduce the amount of tension which is required to preserve the elongated loop and ease in manufacturing of the base fabric. Stuffers present additional advantages which will be discussed in more detail hereinafter.

With reference again to FIG. 7, it will be noticed that alternate stuffers among the stuffers 16 and 16' are shown with different cross hatching than in the prior figures. The differential cross hatching illustrated a construction in which certain of the stuffer yarns do not form part of the final running felt. Accordingly, selected stuffers are comprised of removable yarns. In the preferred embodiment, the removable stuffers are dissolving yarns, such as Solvron two-ply which is available from Hickory, N.C. In an alternative embodiment of the invention, fusible yarns are used in place of the soluble yarns. Thus, with reference to FIG. 7, the selected stuffer yarns 16 would be fusible yarns, such as fusible Wonder Thread monofilament nylon which is available from the Shakespeare Company in Columbia, S.C.

At present, soluble yarns are preferred as the removable yarns due to their ability to be removed after installation of the felt on the papermaking equipment. The soluble yarns may be retained in the finished manufactured felt to preserve loop geometry. After the fabric is installed and placed under tension, the yarns are dissolved from the felts. Since it is desirable to have the option of removing the yarns during the manufacturing or at the installation, soluble yarns are preferred.

With the use of fusible or meltable yarns in the alternative embodiment, the felt after the needling of batt 20 thereto is subjected to the yarn manufacturers suggested temperature and pressure in order to melt or remove the fusible yarns 16. As a result of the melting operation, the fusible yarns Will be dispersed throughout the felt and voids in the seam structure will be created as is shown in FIGS. 12 and 13.

Figure 11:
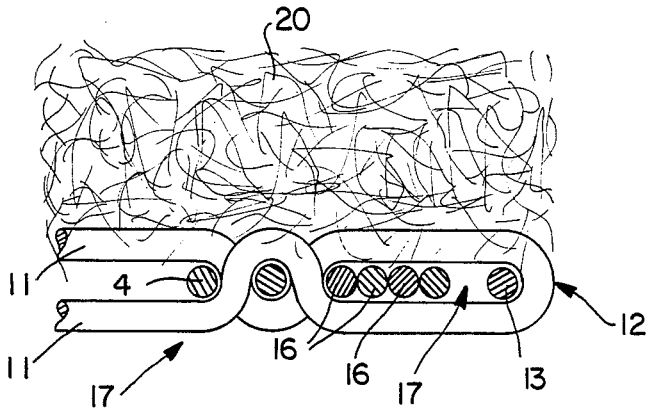
FIG. 11 illustrates one half of the seam construction of FIG. 7 with a batt thereon.

FIG. 11 shows one half of the seam COnstruction of FIG. 7 with a batt 20 thereon. The batt can be needled into the stuffers 16 in the same manner as with the cross machine direction yarns 4. This enables the batt to be strongly anchored to the seam. In addition, the stuffers provide control over differences in the permeability and density between the seam area and the woven fabric and permit balancing of the same between the fabric and the seam.

Figure 12:
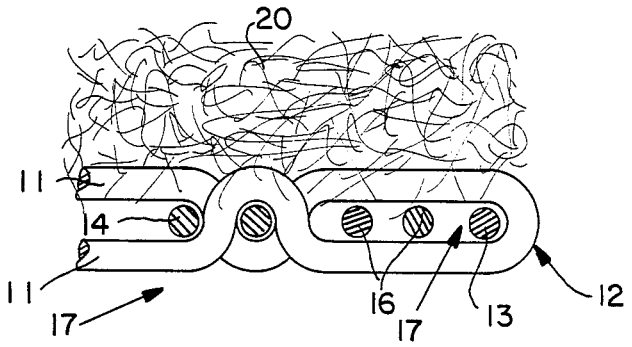
FIG. 12 illustrates the construction of FIG. 11 after removal of selected stuffers.
Figure 13:
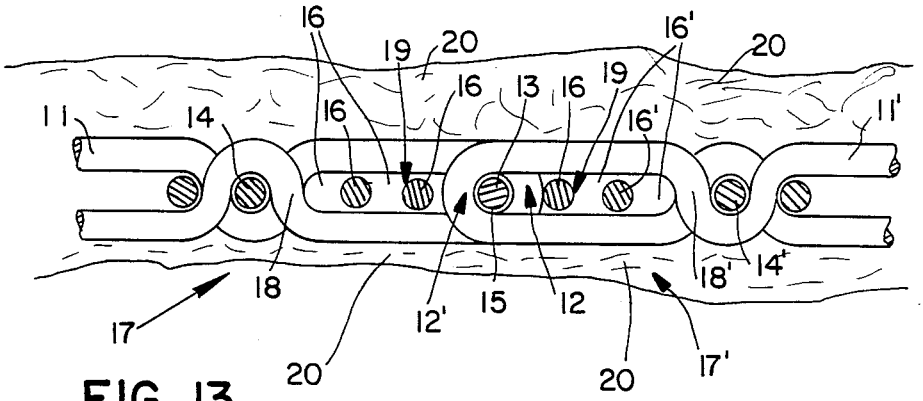
FIG. 13 illustrates the construction of FIG. 12 in a completed seam with batt needled to both sides of the base fabric.

FIGS. 12 and 13 illustrate the construction of FIG. 11 with selected stuffers removed. FIG. 12 illustrates batt material 20 on the paper supporting surface only and FIG. 13 illustrates batt material on both surfaces.

With respect to the pintle, it will be understood by those skilled in the art that one or more pintles may be used and that the pintles are not required to bear a one to one relationship with the cross machine direction yarns. However, it is expected that the actual dimensions of the pintle to be used with the fabric are considered in designing the loop geometry.

Those skilled in the art will appreciate that the many modifications to the above described preferred embodiments may be made without departing from the spirit and scope of the invention.

What I claim is:

1. A seam construction for closing an open papermaker's fabric having a plurality of machine direction yarns interwoven with a plurality of cross machine direction yarns in a repeated pattern throughout the fabric length with each end of the fabric terminated with a plurality of machine direction loops, said seam construction comprised of:

each of said plurality of machine direction loops having a free end defined by a continuous arcuate portion of a respective machine direction yarn and a fixed end defined by adjacent crossing segments of the said respective machine direction yarn as interwoven in the repeated pattern, said segments defining a vertical plane which is substantially perpendicular to the horizontal plane of the fabric;

said machine direction loops at each end of said fabric defining a cross machine direction channel, each of said loops having an internal aperture which has a length equal to at least three times the average diameter of the cross machine direction yarns;

at least two cross machine direction stuffers positioned side by side and adjacent to said crossing segments within each of said channels;

said fabric ends positioned opposite each other with said loops from each end intermeshed with the free ends thereof adjacent the stuffers of the other end to define a pintle channel; and a pintle in said pintle channel.

2. The construction of claim 1 wherein said aperture has a height substantially equal to the diameter of the largest cross machine direction yarn.

3. An improved seam loop construction for closing an open papermaker's fabric having a plurality of machine direction yarns interwoven with a plurality of cross machine direction yarns in a repeated pattern throughout the fabric length with each end of the fabric terminated with a plurality of machine direction loops, said machine direction loops forming a cross machine direction channel at each end of said fabric, wherein said improvement comprises each of said loops defining an interior aperture which has a length equal to at least three times the average horizontal axis of the cross machine direction yarns and a height substantially equal to the average vertical axis of the cross machine direction yarns, each of said machine direction loops having a free end defined by a continuous arcuate portion of a respective machine direction yarn and afixed end defined by adjacent crossing segments of the said respective machine direction yarn as interwoven in the repeated pattern, said adjacent crossing segments defining a vertical plane which is substantially perpendicular to a plane extending through the horizntal axis of said cross machine direction yarns and each of the respective cross machine direction channels is a continuous open channel.

4. A seam construction for closing an open papermaker's fabric having a plurality of machine direction yarns interwoven with a plurality of cross machine direction yarns in a repeated pattern throughout the fabric length with each end of the fabric terminated with a plurality of machine direction loops, said seam construction comprised of:

each of said plurality of machine direction loops having a free end defined by a continuous arcuate portion of the machine direction yarn and a fixed end defined by adjacent crossing segments of the said machine direction yarn as interwoven in the repeated pattern, said segments defining a vertical plane which is substantially perpendicular to the horizontal plane defined by said cross machine direction yarns;

said machine direction loops at each end of said fabric defining a cross machine direction channel, each of said loops having an internal aperture which has a longitudinal dimension equal to at least three times the average longitudinal dimension of the cross machine direction yarns and a vertical dimension no greater than the largest vertical dimension of a cross machine direction yarn;

at least two cross machine direction stuffers positioned side by side and adjacent to said crossing segments within each of said channels;

said fabric ends positioned opposite each other with said loops from each end intermeshed with the free ends thereof adjacent the stuffers of the other end to define a pintle channel; and a pintle in said pintle channel.

5. The construction of claim 4 wherein the said loops are formed from loom woven machine direction yarns.

6. An improved seam loop construction for closing an open, endless woven papermaker's fabric having a plurality of machine direction yarns interwoven with a plurality of cross machine direction yarns in a repeated pattern throughout the fabric length with each end of the fabric terminated with a plurality of loom woven machine direction loops, said machine direction loops forming a cross machine direction channel at each end of said fabric, wherein said improvement comprises each of said loops defining an interior aperture which has a length equal to at least three times the average horizontal axis of the cross machine direction yarns and a height substantially equal to the average vertical axis of the cross machine direction yarns, each of said machine direction loops having a free end defined by a continuous arcuate portion of a respective machine direction yarn and a fixed end defined by adjacent parallel segments of the said respective machine direction yarn as interwoven in the repeated pattern, said adjacent parallel segments defining a vertical plane which is substantially perpendicular to a plane extending through the horizontal axis of said cross machine direction yarns.

7. A loom woven seam construction for closing an open fabric into an endless loop characterized by loops at each end of the fabric which are formed from continuous machine direction yarns that weave in a crossing pattern and define a vertical plane which is substantially perpendicular to the horizontal plane of the fabric, each of said loops having substantially the same length L which is at least three times the average of the cross machine direction yarns whereby the loops at each end of the fabric define an open channel.

8. A seam construction for closing an open papermaker's fabric having a plurality of machine direction yarns interwoven with a plurality of cross machine direction yarns in a repeated pattern throughout the fabric length with each end of the fabric terminated with a plurality of machine direction loops, said seam construction comprised of:

each of said plurality of machine direction loops having a free end defined by a continuous arcuate portion of a respective machine direction yarn and a fixed end defined by adjacent crossing segments of the said respective machine direction yarn as interwoven in the repeated pattern, said segments defining a vertical plane which is substantially perpendicular to the horizontal plane of the fabric;

said machine direction loops at each end of said fabric defining an uninterrupted, open cross machine direction channel, each of said loops having an internal aperture which has substantially the same length L which is equal to at least three times the average diameter of the cross machine direction yarns;

said fabric ends positioned opposite each other with said loops from each end intermeshed to define a pintle channel; and a pintle in said pintle channel.

9. The construction of claim 8 further comprised of at least one cross machine direction stuffer within each of said channels.

10. The construction of claim 8 further comprised of at least two cross machine direction stuffers within each of said channels.

* * * * *